US008192210B2

(12) United States Patent
Gardner et al.

(10) Patent No.: US 8,192,210 B2
(45) Date of Patent: Jun. 5, 2012

(54) GROUND CLAMP KIT

(75) Inventors: Michael J. Gardner, Hudson, OH (US); Glenn A. Baker, Cleveland, OH (US)

(73) Assignee: Halex Co./a Scott-Fetzer Company, Cleveland, OH (US)

( * ) Notice: Subject to any disclaimer, the term of this patent is extended or adjusted under 35 U.S.C. 154(b) by 0 days.

(21) Appl. No.: 13/081,142

(22) Filed: Apr. 6, 2011

(65) Prior Publication Data

US 2011/0294364 A1 Dec. 1, 2011

Related U.S. Application Data

(60) Provisional application No. 61/321,283, filed on Apr. 6, 2010.

(51) Int. Cl.
*H01R 13/648* (2006.01)

(52) U.S. Cl. ..... 439/100

(58) Field of Classification Search ..... 439/100, 439/101, 92, 98, 799, 803, 804
See application file for complete search history.

(56) References Cited

U.S. PATENT DOCUMENTS

| | | | | |
|---|---|---|---|---|
| 3,988,052 | A | 10/1976 | Mooney et al. | |
| 6,976,857 | B1 * | 12/2005 | Shukla et al. | 439/100 |
| 7,018,221 | B2 * | 3/2006 | Daume | 439/100 |
| 7,503,776 | B1 * | 3/2009 | Pavlovic et al. | 439/98 |
| 7,637,754 | B1 | 12/2009 | Yerena et al. | |
| 7,992,829 | B1 * | 8/2011 | Baker et al. | 248/73 |

* cited by examiner

*Primary Examiner* — Tulsidas C Patel
*Assistant Examiner* — Phuongchi Nguyen
(74) *Attorney, Agent, or Firm* — Emerson Thomson Bennett; Roger D. Emerson, Esq.

(57) ABSTRACT

A ground clamp kit may include a first clamp having a wire reception member suitable to receive and electrically connect to an associated electrical wire to be grounded and a second clamp. Each clamp may be suitable to be clamped to an associated grounding component. The ground clamp kit may also include an electric conductor that electrically connects the first clamp to the second clamp.

20 Claims, 9 Drawing Sheets

GROUND CLAMP KIT

This patent claims priority from Provisional Patent Application Ser. No. 61/321,283 titled GROUND CLAMP, filed on Apr. 6, 2010, which provisional application is hereby incorporated by reference in its entirety.

BACKGROUND

A. Field of Invention

This invention relates to grounding clamps, and more particularly, to a ground clamp kit that includes two clamps that are used to electrically connect an electrical wire to at least one grounding component.

B. Description of the Related Art

Ground clamps that are used to electrically connect electrical devices to a grounding component, such as ground rods, pipe and rebar are well known. One known ground clamp includes a first clamp member, a second clamp member, and a wire reception member suitable to receive and electrically connect to an electrical wire to be grounded. The first and second clamp members are adjustable to clamp between them a grounding component. Once properly connected, the ground clamp completes an electric connection between the electrical wire and the grounding component thereby grounding the electric wire and any electrically connected electrical device.

While many known ground clamps work well for their intended purpose, there is a need for improved ground clamps. Recent changes in the National Electric Code (NEC), for example, require that the grounding path not rely on water meters or filtering devices or similar equipment. The NEC also requires that the grounding path be provided around insulated joints and around any equipment likely to be disconnected for repairs or replacement. Meeting these requirements with known ground clamps is cumbersome and necessitates excessive components and excessive installation time. There is therefore a need for a ground clamp that can easily meet these NEC requirements while being simple to install.

SUMMARY

According to one embodiment of this invention, a ground clamp kit may comprise a first clamp comprising: a first clamp member having a contact surface; a second clamp member having a contact surface; first and second mechanical connectors; and, a wire reception member suitable to receive and electrically connect to an associated electrical wire to be grounded. The first and second clamp members may be adjustable with the first mechanical connector to clamp between their contact surfaces an associated grounding component. The second mechanical connector may secure the associated electrical wire to the wire reception member. The ground clamp kit may also comprise a second clamp comprising: a first clamp member having a contact surface; a second clamp member having a contact surface; and, a first mechanical connector. The first and second clamp members are adjustable with the first mechanical connector to clamp between their contact surfaces an associated grounding component. The ground clamp kit may also comprise an electric conductor that electrically connects the first clamp to the second clamp. The electric conductor may be an un-insulated copper wire that comprises a coil having at least one loop of 360 degrees.

According to another embodiment of this invention, a ground clamp kit may comprise a first clamp comprising: a first clamp member; a second clamp member; and a wire reception member suitable to receive and electrically connect to an associated electrical wire to be grounded. The first and second clamp members may be adjustable to clamp between them an associated grounding component. The ground clamp kit may also comprise a second clamp comprising: a first clamp member; and, a second clamp member. The first and second clamp members may be adjustable to clamp between them an associated grounding component. The ground clamp kit may also comprise an electric conductor that electrically connects the first clamp to the second clamp.

According to yet another embodiment of this invention, a method may comprise the steps of: (A) providing an electrical wire to be grounded; (B) providing at least one grounding component; (C) providing a ground clamp kit comprising: (1) a first clamp comprising: a first clamp member; a second clamp member; and a wire reception member; (2) a second clamp comprising: a first clamp member; and, a second clamp member; and, (3) an electric conductor that electrically connects the first clamp to the second clamp; (D) adjusting the first and second clamp members of the first clamp to clamp between them the at least one grounding component; (E) adjusting the first and second clamp members of the second clamp to clamp between them the at least one grounding component; and, (F) electrically connecting the electrical wire to the wire reception member to electrically ground the electrical wire to the at least one grounding component.

Many benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
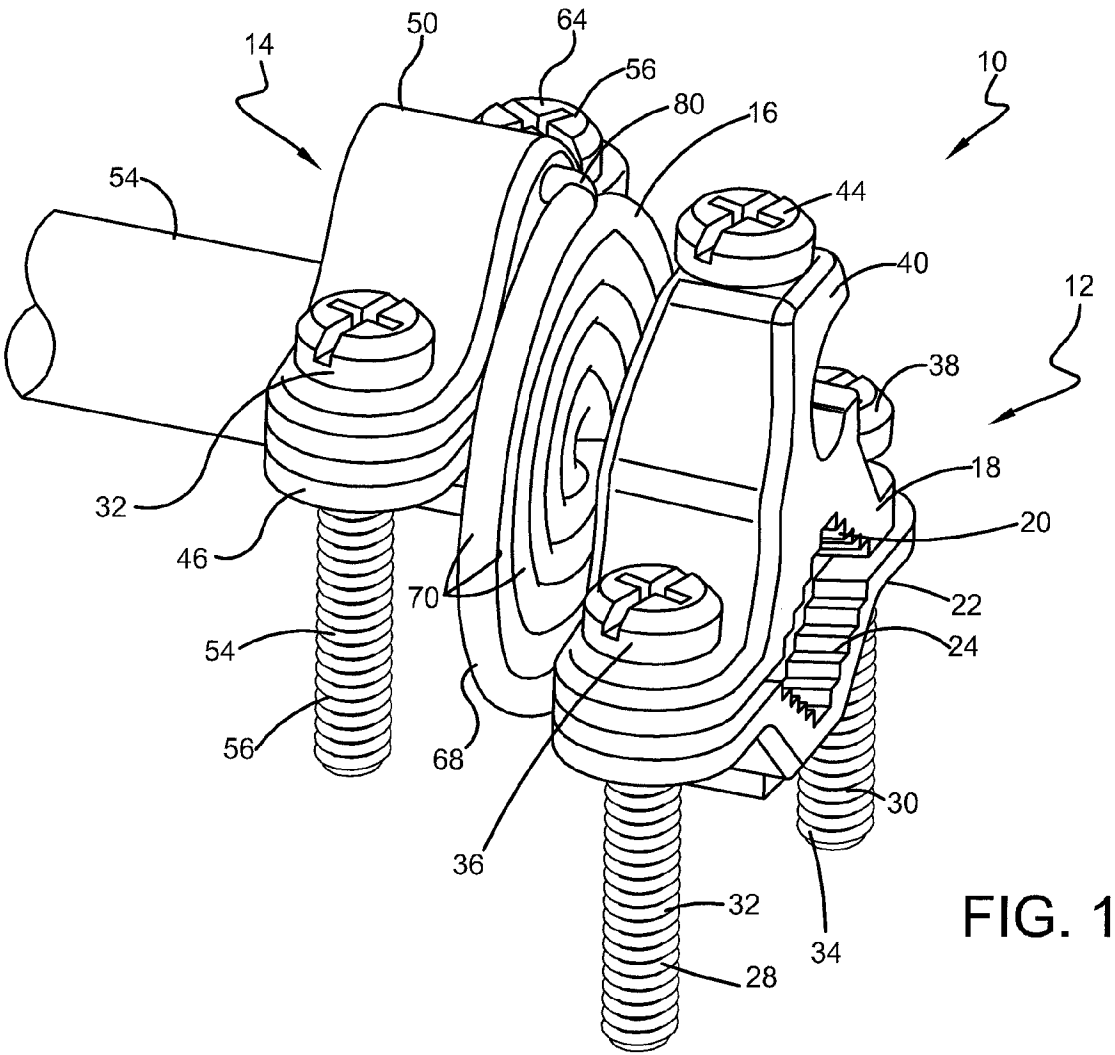
FIG. 1 is a perspective view of a ground clamp kit according to one embodiment of the invention.
Figure 2:
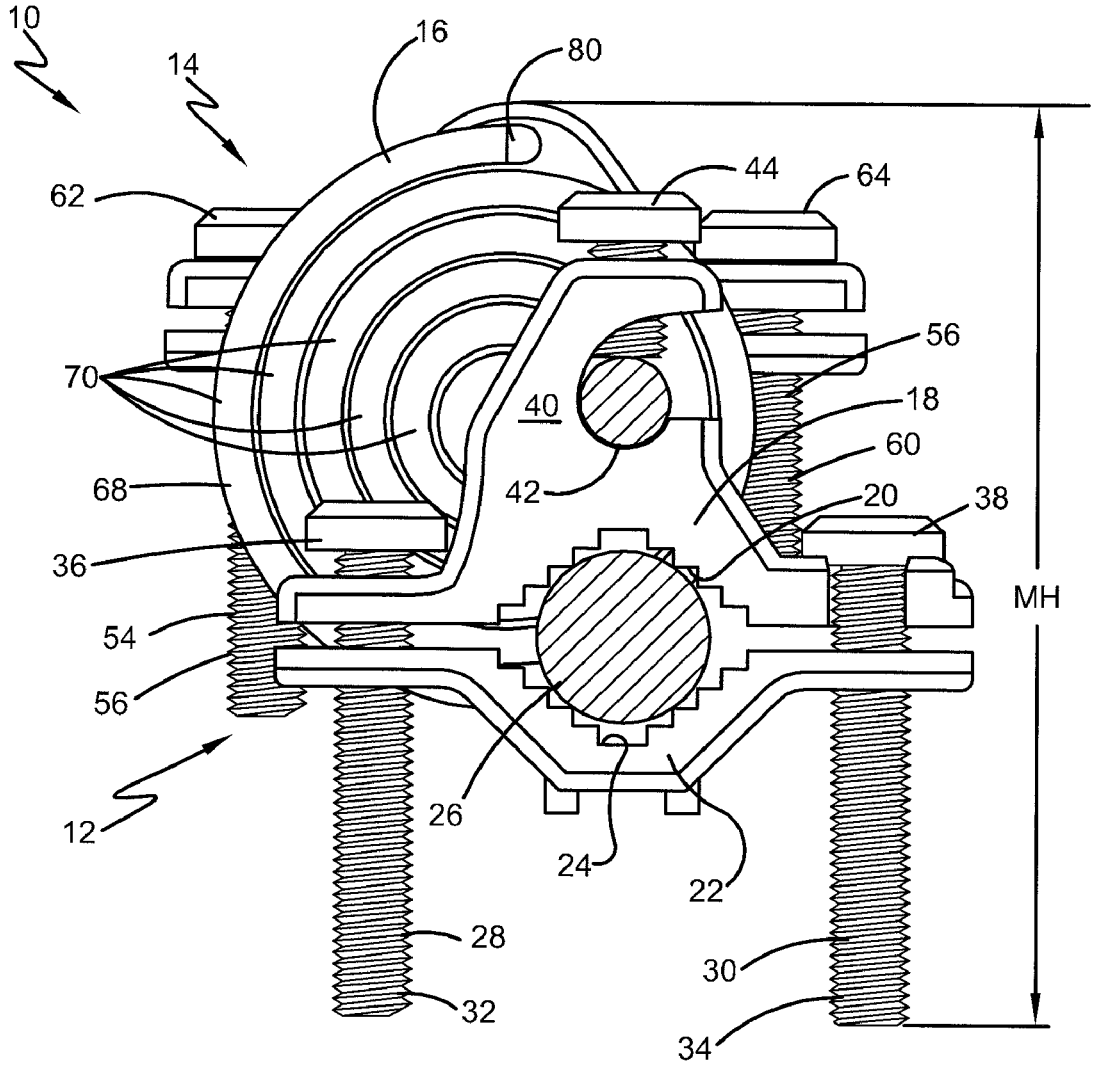
FIG. 2 is an end view of the ground clamp kit shown in FIG. 1.
Figure 3:
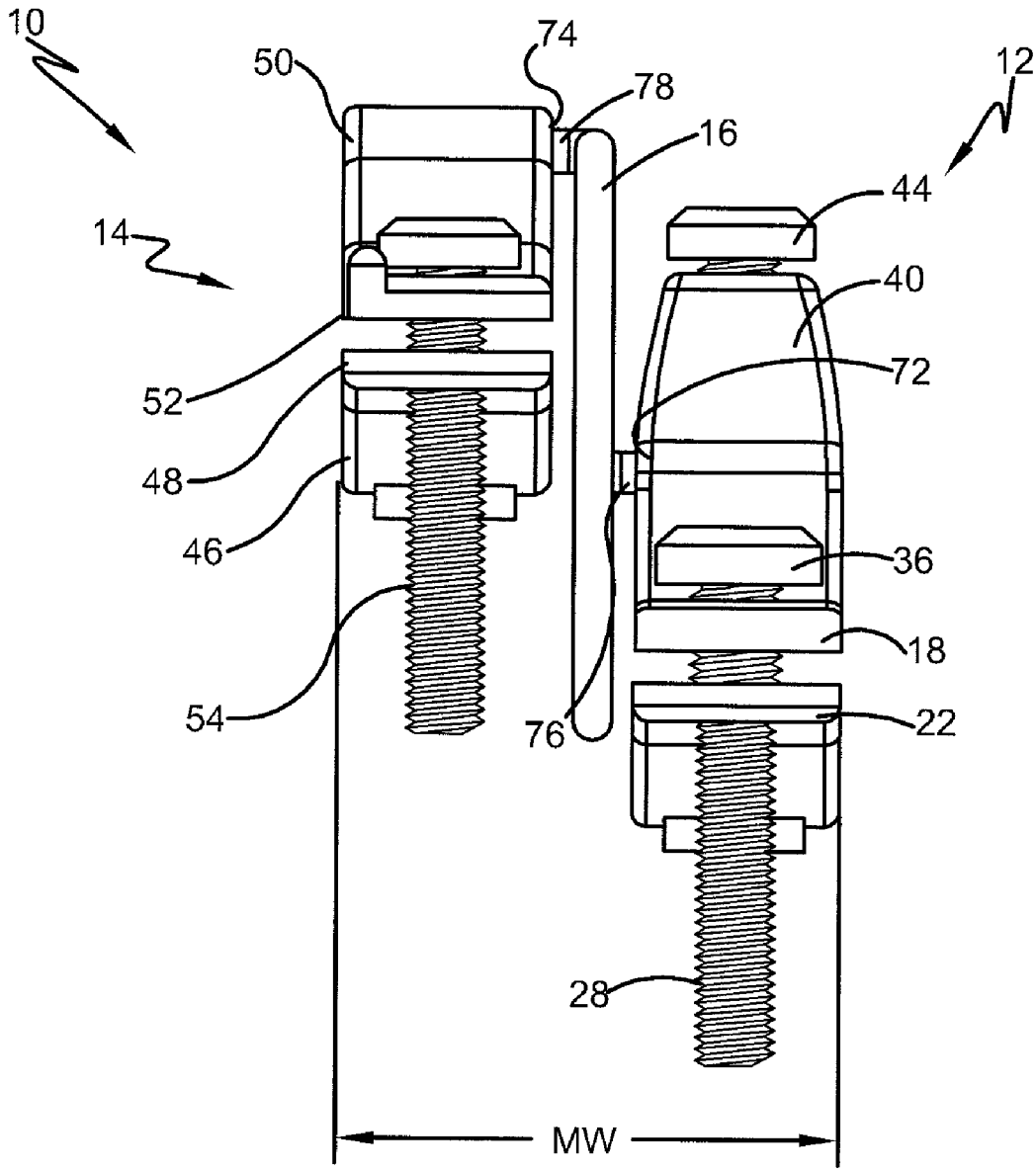
FIG. 3 is a side view of the ground clamp kit shown in FIG. 1.

Referring now to the drawings wherein the showings are for purposes of illustrating embodiments of the invention only and not for purposes of limiting the same, and wherein like reference numerals are understood to refer to like components, FIGS. 1-3 show a ground clamp kit 10 according to one embodiment of this invention. The ground clamp kit 10 may include a first clamp 12, a second clamp 14, and an electric conductor 16 that electrically connects the first clamp 12 to the second clamp 14. The first clamp 12 may have a first clamp member 18 with a contact surface 20 and a second clamp member 22 with a contact surface 24. The first and second clamp members 18, 22 are adjustable to clamp between their contact surfaces 20, 24 a grounding component 26 (illustrated in FIG. 2). The grounding component 26 may be of any type suitable for grounding purposes such as a ground rod, a conduit, a pipe or a rebar. The contact surfaces 22, 24 can be designed in any manner chosen with the sound judgment of a person of skill in the art. For the embodiment shown, the contact surfaces 22, 24 are convex shaped and have a textured surface to more fully receive and contact the grounding component 26. There are many ways, known to those of skill in the art, to adjust clamp members to clamp an object that will work suitably with this invention. For the embodiment shown, a pair of mechanical connectors 28, 30 is inserted into holes on opposite ends of the clamp members 18, 22. The connectors shown 28, 30, are screws having threads 32, 34 that are received in mating threads formed on the second clamp member 22 on the surfaces defining the holes. The screws 28, 30 may also have heads 36, 38 that are designed to receive a tool, such as a screwdriver. The screws 28, 30 can then be rotated in a known way to clamp against an object, such as the grounding component 26, and be removed from the object.

With continuing reference to FIGS. 1-3, the first clamp 12 may also have a wire reception member 40 suitable to receive and electrically connect to an electrical wire 42 (illustrated in FIG. 2) to be grounded. The electrical wire 42 can be of any type and size to be grounded chosen with the sound judgment of a person of skill in the art. There are many wire reception members, known to those of skill in the art, which will work suitably with this invention. For the embodiment shown, the wire reception member 40 comprises a C-shaped opening formed on the first clamp member 18 opposite the contact surface 20. The upper portion of the wire reception member 40 threadingly receives a mechanical connector, such as a screw 44, that is rotated in a known way to secure the electrical wire 42 to the wire reception member 40 as is known to those of skill in the art.

Still referring to FIGS. 1-3, the second clamp 14 may have a first clamp member 46 with a contact surface 48 and a second clamp member 50 with a contact surface 52. The contact surfaces 48, 52 are only barely visible but there design may be similar to the contact surfaces 20, 24. The first and second clamp members 46, 50 are adjustable to clamp between their contact surfaces 48, 52 a grounding component 54 (illustrated in FIG. 1). The grounding component 54 may be of any type suitable for grounding purposes such as a ground rod, a conduit, a pipe or a rebar. In application, the second clamp 14 may in some embodiments be clamped to the same grounding component as the first clamp 12. In other embodiments, the second clamp 14 may be clamped to a grounding component that is distinct from the grounding component the first clamp 12 is clamped to. This will be discussed further below. The contact surfaces 48, 52 can be designed in any manner chosen with the sound judgment of a person of skill in the art but for the embodiment shown they are convex shaped and have a textured surface to more fully receive and contact the grounding component 54. While there are many ways, known to those of skill in the art, to adjust clamp members to clamp an object that will work suitably with this invention, for the embodiment shown, a pair of mechanical connectors 54, 56 are inserted into holes on opposite ends of the clamp members 46, 50. The connectors shown 54, 56, are screws having threads 58, 60 that are received in mating threads formed on the second clamp member 50 on the surfaces defining the holes. The screws 54, 56 may also have heads 62, 64 that are designed to receive a tool, such as a screwdriver. The screws 54, 56 can then be rotated in a known way to clamp against an object, such as the grounding component 54, and be removed from the object.

With continuing reference to FIGS. 1-3, the electric conductor 16 electrically connects the first clamp 12 to the second clamp 14. This permits the grounding charge to be sent between the clamps 12, 14. The electric conductor 16 used with this invention can be of any size, type and style chosen with the sound judgment of a person of skill in the art. For the embodiment shown, the electric conductor 16 is an un-insulated copper wire that comprises a coil 68 having several loops 70. The use of a coil 68 makes for easy packaging of the ground claim kit 10 while also making it easy to position the clamps 12, 14 at a suitable distance from each other in application. The number of loops 70 used can be varied depending on the application. For the embodiment shown, there are five loops 70 of 360 degrees. The manner in which the electric conductor 16 is connected to the first and second clamps 12, 14 can be any chosen with the sound judgment of a person of skill in the art. In one embodiment, seen best in FIG. 3, each clamp has a hole 72, 74 that receives a leg 76, 78 formed at an end of the electric conductor 16. For the embodiment shown, the holes 72, 74 are formed in the first clamp members 18, 46 but this is exemplary only. Each leg 76, 78 may then be inserted into the respective hole 72, 74 and welded to the clamp 12, 14.

Still referring to FIGS. 1-3, in another embodiment, the clamps 12, 14 are rotatably connected to the electric conductor 16. This rotatable connection permits the clamps 12, 14 to be oriented to take up very little space which is ideal for packaging. The rotatable connection also permits the clamps 12, 14 to be easily rotated with respect to the electric conductor 16 in application. In one specific embodiment, this rotatable connection is accomplished by providing the legs 76, 78 of the electric conductor 16 to be only loosely inserted within the holes 72, 74 in the clamps 12, 14. The operator can then easily rotate the clamps 12, 14 with respect to the electric conductor 16 to determine the proper orientation for a specific application. The operator can then weld the legs 76, 78 in place. In another specific embodiment, the proximal ends of the legs 76, 78 are pre-welded within the holes 72, 74 and the distal ends of the legs 76, 78 are rotatbly connected to the electric conductor 16. In one specific embodiment, the legs 76, 78 are rotatbly connected to corresponding elbows 80, 82. In this way the electric conductor 16 remains properly connected to the clamps 12, 14 but the operator can easily adjust the position of the clamps 12, 14 in application.

Figure 7:
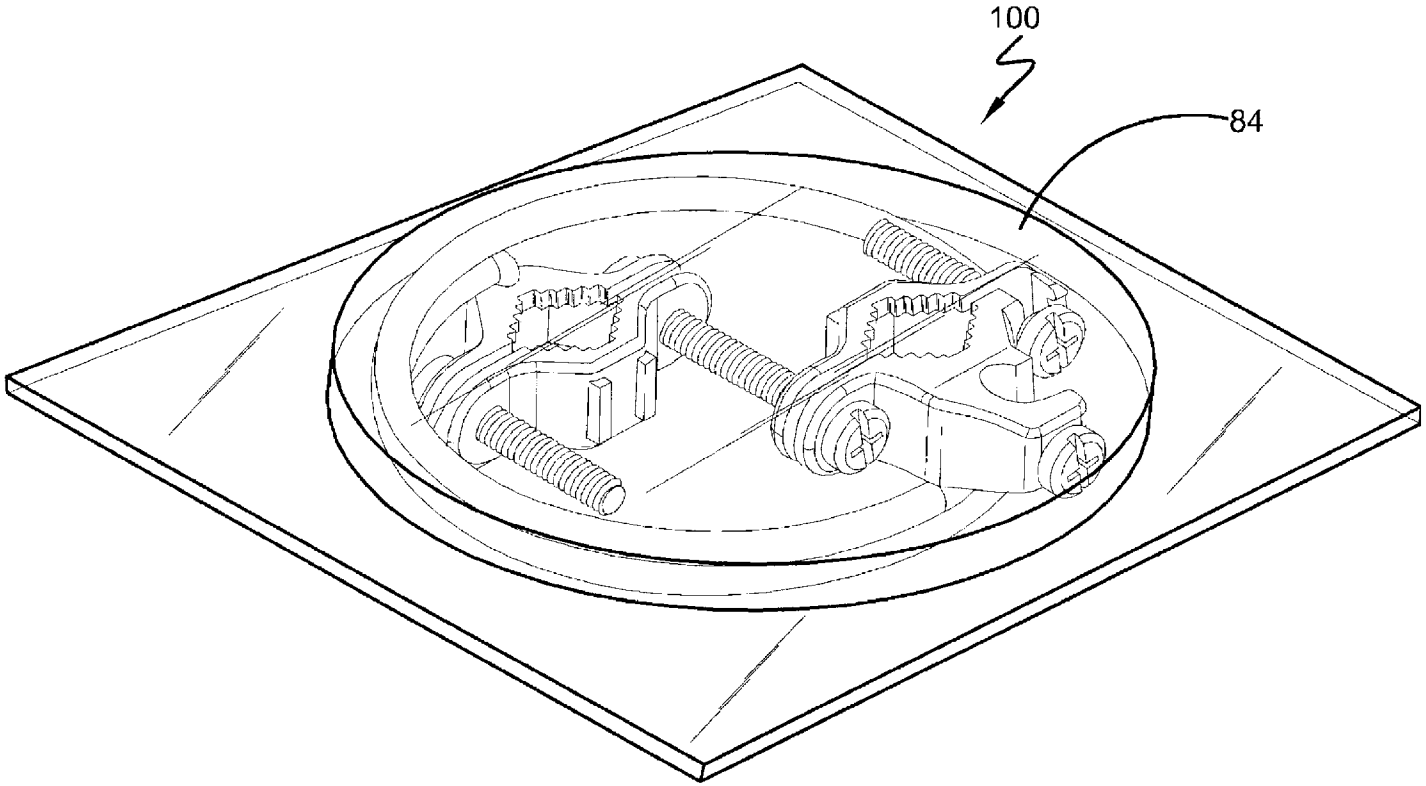
FIG. 7 is a perspective view of a ground clamp kit in a package.

With reference now to FIGS. 2-3, the ground clamp kit 10 may come in a package (FIG. 7 shows another embodiment within a package 84.) As noted above, the use of a coil 68 as well as rotatable connections of the clamps 12, 14 to the electric conductor 16 makes it easy to minimize the size of the ground clamp kit 10 for packaging purposes. The ground clamp kit 10 may have a maximum height MH and a maximum width MW. While the ground clamp kit 10 can be of any size chosen with the sound judgment of a person of skill in the art, for the embodiment shown in FIGS. 1-3, the maximum height MH is approximately 2.9 inches and the maximum width MW is approximately 1.6 inches. The ground clamp kit 10 shown in FIGS. 1-3 is ideally sized for use with a house or other building having up to 125 ampere service. The copper wire forming the coil 68 is 8-gauge solid and the coil 68 is approximately 24 inches long and 2.5 inches in diameter. The clamps 12, 14 may be formed of cast bronze and the mechanical connectors 28, 30, 44, 54, 56 may be zinc plated steel.

Figure 4:
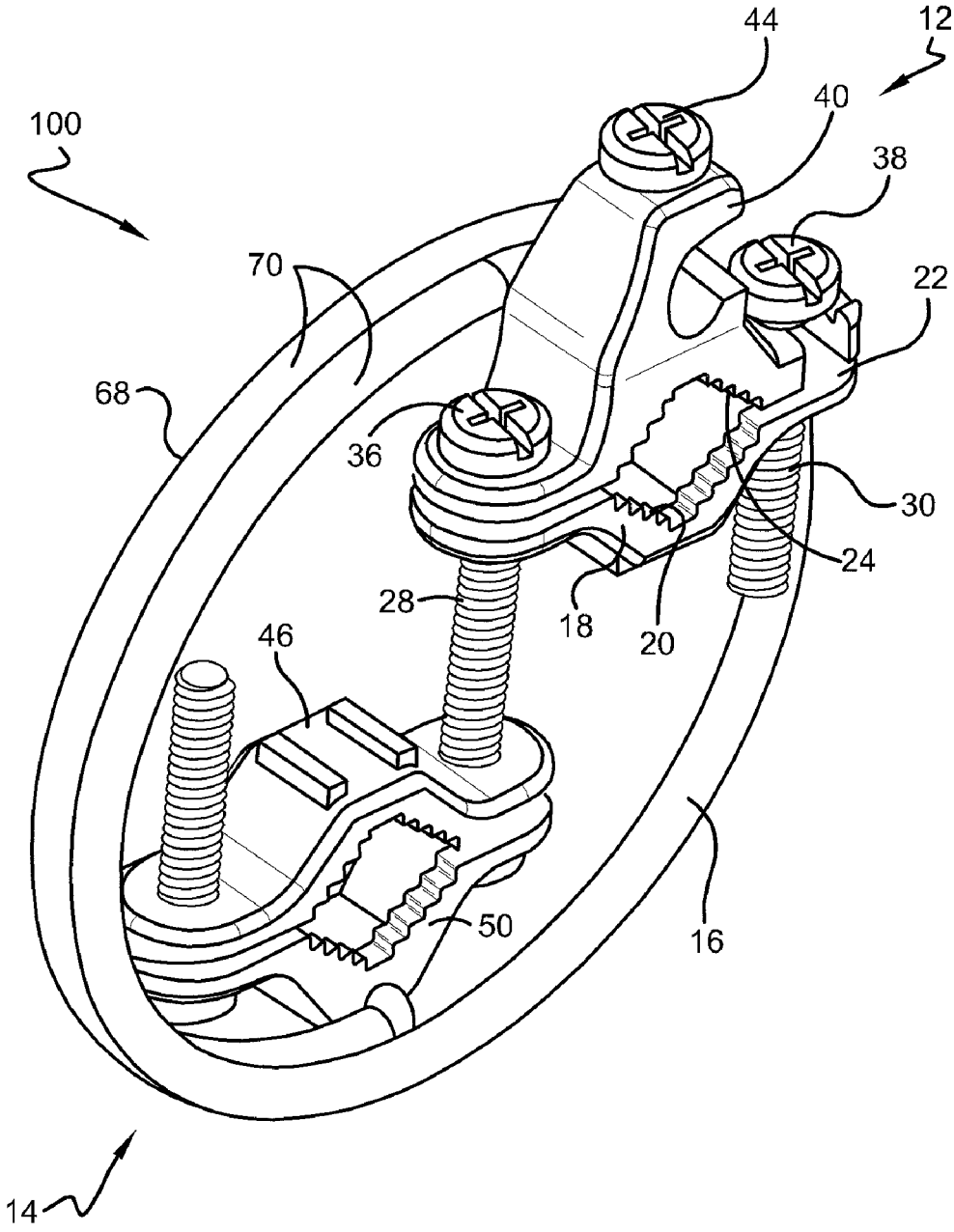
FIG. 4 is a perspective view of a ground clamp kit according to another embodiment of the invention.
Figure 5:
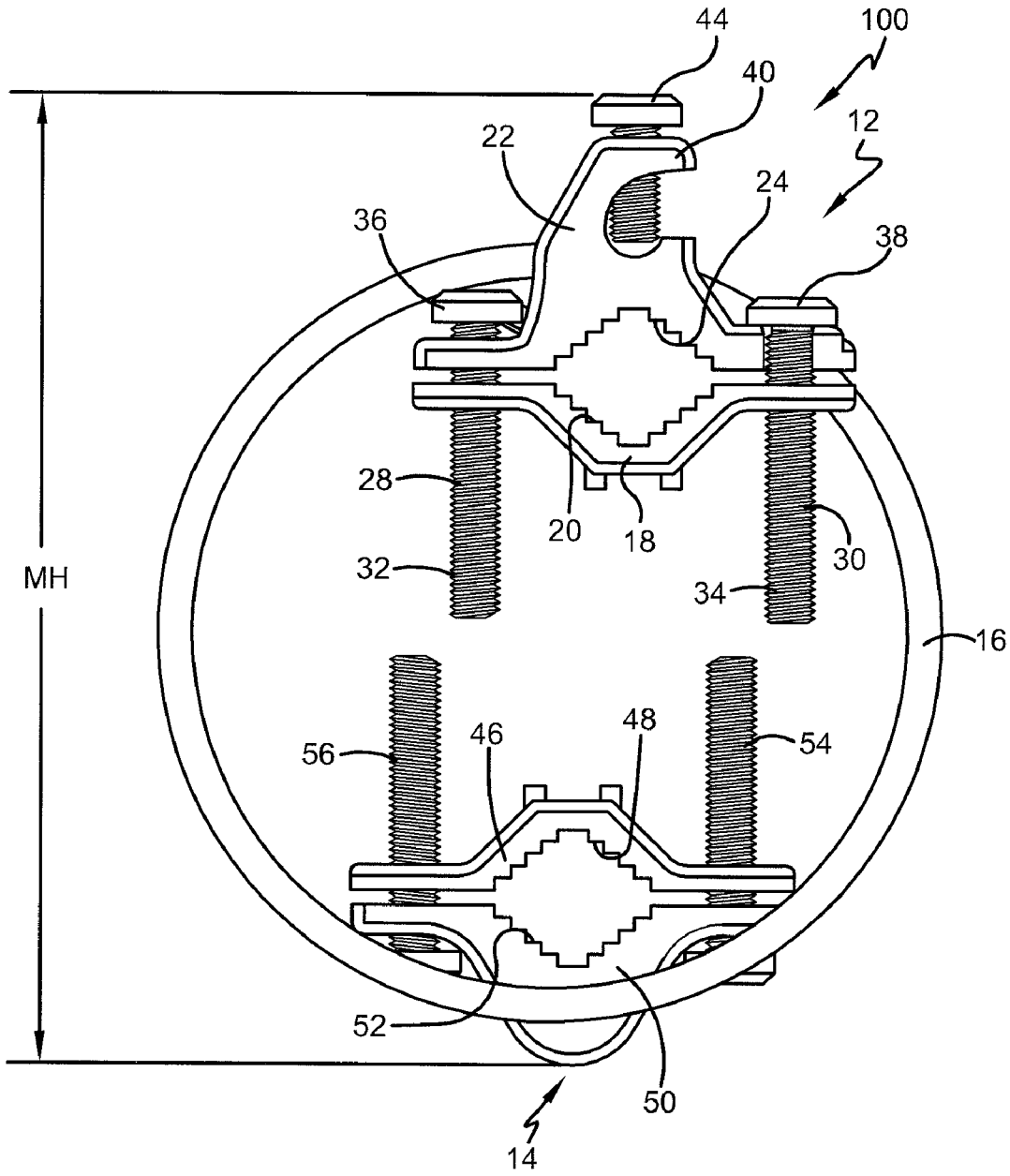
FIG. 5 is an end view of the ground clamp kit shown in FIG. 4.
Figure 6:
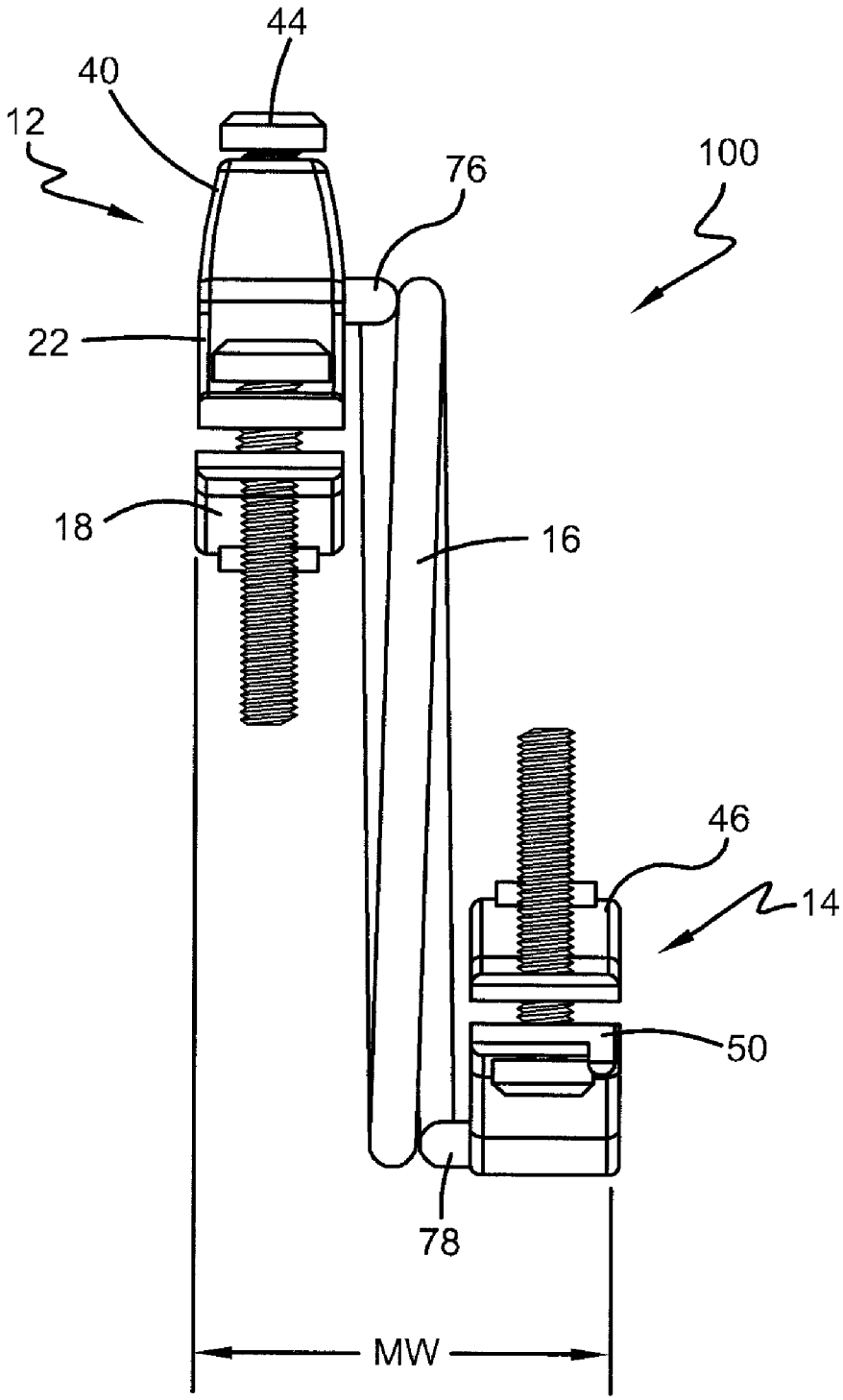
FIG. 6 is a side view of the ground clamp kit shown in FIG. 4.

With reference now to FIGS. 4-7, another embodiment ground clamp kit 100 is shown. Because the primary components of the ground clamp kit 100 as well as its operation are similar to the components and operation of the ground claim kit 10, the same reference numbers will be used for similar components. The differences between the ground clamp kit 100 and the ground clamp kit 10 will now be discussed. The coil 68 for this embodiment has fewer loops 70. The specific embodiment shown has one loop 70 of 360 degrees and a second loop 70 of approximately 180 degrees. Of course the precise number of loops 70 can be varied according to application. While the ground clamp kit 100 can be of any size chosen with the sound judgment of a person of skill in the art, for the embodiment shown in FIGS. 4-6, the maximum height MH is approximately 5.0 inches and the maximum width MW is approximately 1.5 inches. The ground clamp kit 100 shown in FIGS. 4-6 is ideally sized for use with a house or other building having up to 225 ampere service. The copper wire forming the coil 68 is 4-gauge solid and the coil 68 is approximately 24 inches long and 4.0 inches in diameter. The clamps 12, 14 may be formed of cast bronze and the mechanical connectors 28, 30, 44, 54, 56 may be zinc plated steel.

Figure 8:
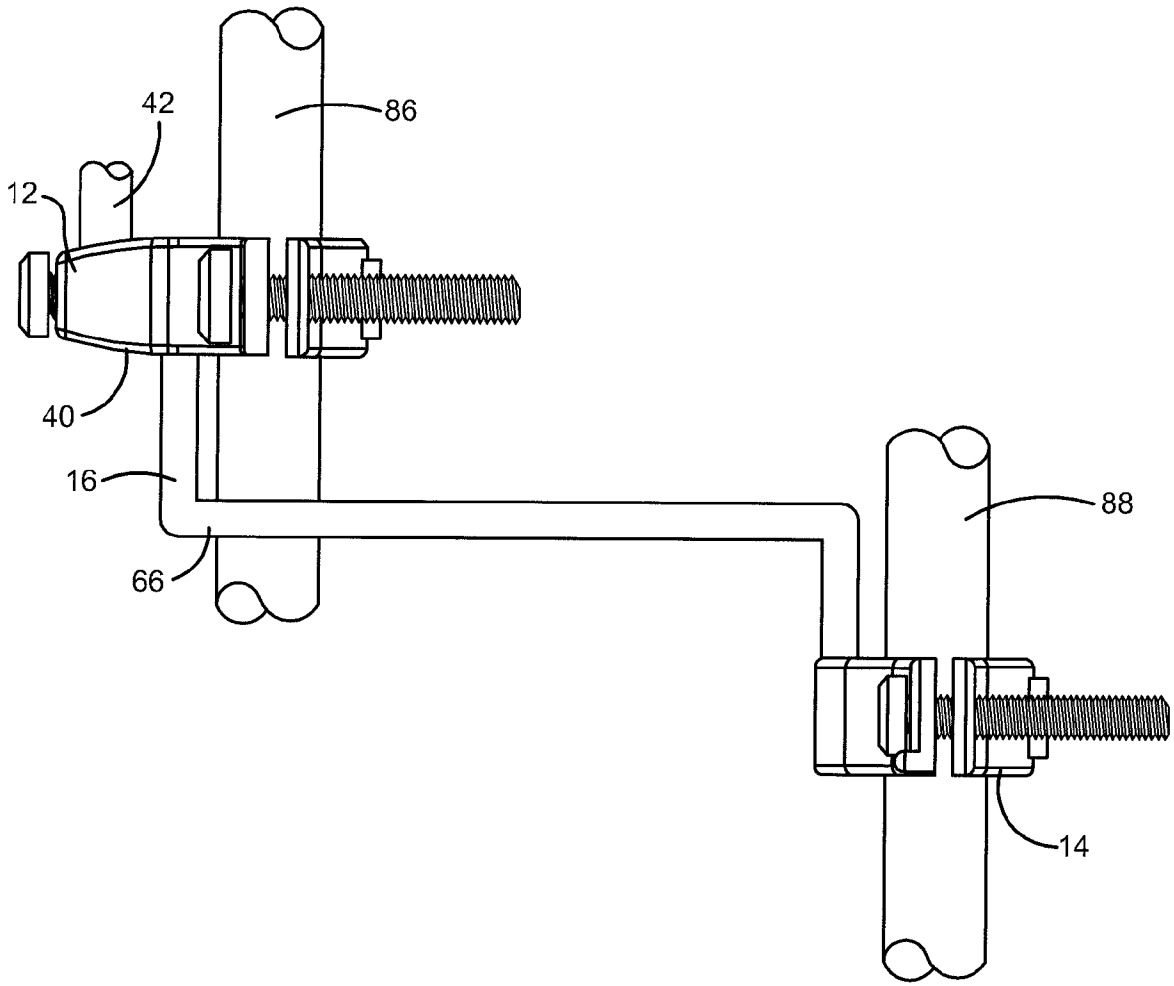
FIG. 8 is a schematic representation of a ground clamp kit used in one application.
Figure 9:
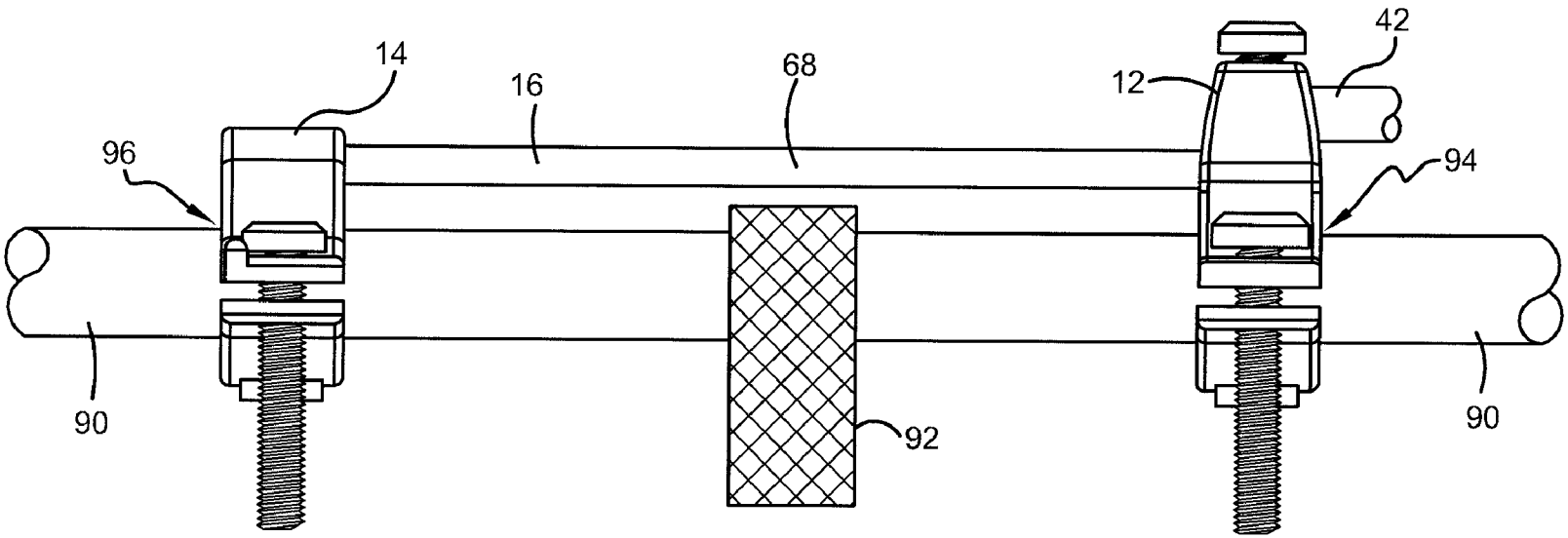
FIG. 9 is a schematic representation of a ground clamp kit used in another application.

With reference now to FIGS. 1-6 and 8, the operation of the ground clamp kits 10, 100 will now be described. The operator first determines the ampere service requirement and then selects an appropriately sized ground clamp kit. The operator then determines the specific application. If, for example as shown in FIG. 8, the specific application requires the use of two distinct grounding components 86, 88 (a specific non-limiting example of two distinct grounding components is a hot water heater's cold line/pipe and its hot line/pipe), the operator adjusts either the first or second clamp 12 or 14 to clamp the first grounding component 86. The operator then moves the other clamp 14 or 12 toward the second grounding component 88. This motion may cause the clamps 12, 14 to rotate relative to the ends of the electric conductor 16 and may cause the coil 66 to least partially uncoil. The operator then adjusts the other clamp 14 or 12 to clamp the second grounding component 88. The electrical wire 42 to be grounded is then connected to the wire reception member 40.

With reference now to FIGS. 1-6 and 9, another specific application example may require the use of a single grounding component 90 but on opposite sides of a device 92 attached to the grounding component 90 (the device may be, for one non-limiting example, a water meter). In this example the operator adjusts the first or second clamp 12 or 14 to clamp a first surface 94 of the grounding component 90 on one side of the device 92. The operator then moves the other clamp 14 or 12 toward a second surface 96 of the grounding component 90. This motion may cause the clamps 12, 14 to rotate relative to the ends of the electric conductor 16 and may cause the coil 68 to least partially uncoil. The operator then adjusts the other clamp 14 or 12 to clamp the second surface 96 of the grounding component 90. The electrical wire 42 to be grounded is then connected to the wire reception member 40.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A ground clamp kit comprising:

a first clamp comprising: a first clamp member having a contact surface; a second clamp member having a contact surface; first and second mechanical connectors; and, a wire reception member suitable to receive and electrically connect to an associated electrical wire to be grounded; wherein the first and second clamp members are adjustable with the first mechanical connector to clamp between their contact surfaces an associated grounding component; wherein the second mechanical connector secures the associated electrical wire to the wire reception member;

a second clamp comprising: a first clamp member having a contact surface; a second clamp member having a contact surface; and, a first mechanical connector; wherein the first and second clamp members are adjustable with the first mechanical connector to clamp between their contact surfaces an associated grounding component; and, an electric conductor that electrically connects the first clamp to the second clamp;

wherein the electric conductor is an un-insulated copper wire that comprises a coil having at least one loop of 360 degrees.

2. The ground clamp kit of claim 1 wherein:

the first and second clamps are rotatably connected to the electric conductor.

3. The ground clamp kit of claim 2 wherein:

a first end of the electric conductor is welded to the first clamp; and, a second end of the electric conductor is welded to the second clamp.

4. The ground clamp kit of claim 3 wherein:

the first clamp has a hole;

the second clamp has a hole;

a first end of the electric conductor is inserted into the hole in the first clamp; and, a second end of the electric conductor is inserted into the hole in the second clamp.

5. The ground clamp kit of claim 4 wherein:

the electric conductor comprises: a first end having a first leg that is attached to the first clamp and that is rotatably connected to a first elbow; and, a second end having a second leg that is attached to the second clamp and that is rotatably connected to a second elbow.

6. The ground clamp kit of claim 4 wherein:

the electric conductor comprises a coil having at least a first loop of 360 degrees and at least a second loop of at least 180 degrees.

7. A ground clamp kit comprising:

a first clamp comprising: a first clamp member; a second clamp member; and a wire reception member suitable to receive and electrically connect to an associated electrical wire to be grounded; wherein the first and second clamp members are adjustable to clamp an associated grounding component;

a second clamp comprising: a first clamp member; and, a second clamp member; wherein the first and second clamp members are adjustable to clamp an associated grounding component; and, an electric conductor that electrically connects the first clamp to the second clamp.

8. The ground clamp kit of claim 7 wherein:

the first and second clamps are rotatably connected to the electric conductor.

9. The ground clamp kit of claim 7 wherein:

a first end of the electric conductor is welded to the first clamp; and, a second end of the electric conductor is welded to the second clamp.

10. The ground clamp kit of claim 7 wherein:
the first clamp has a hole;
the second clamp has a hole;
a first end of the electric conductor is inserted into the hole in the first clamp; and,
a second end of the electric conductor is inserted into the hole in the second clamp.

11. The ground clamp kit of claim 7 wherein:
the electric conductor is an un-insulated copper wire.

12. The ground clamp kit of claim 7 wherein:
the electric conductor comprises a coil having at least one loop of 360 degrees.

13. The ground clamp kit of claim 12 wherein:
the electric conductor comprises: a first end having a first leg that is attached to the first clamp and that is rotatably connected to a first elbow; and, a second end having a second leg that is attached to the second clamp and that is rotatably connected to a second elbow.

14. A method comprising the steps of:
(A) providing an electrical wire to be grounded;
(B) providing at least one grounding component;
(C) providing a ground clamp kit comprising: (1) a first clamp comprising: a first clamp member; a second clamp member; and a wire reception member; (2) a second clamp comprising: a first clamp member; and, a second clamp member; and, (3) an electric conductor that electrically connects the first clamp to the second clamp;
(D) adjusting the first and second clamp members of the first clamp to clamp between them the at least one grounding component;
(E) adjusting the first and second clamp members of the second clamp to clamp between them the at least one grounding component; and,
(F) electrically connecting the electrical wire to the wire reception member to electrically ground the electrical wire to the at least one grounding component.

15. The method of claim 14 wherein prior to steps (D) and (E) the method comprises the step of:
rotating at least one of the first and second clamps with respect to the electric conductor.

16. The method of claim 14 wherein:
step (B) comprises the step of providing a grounding component having a first surface and a second surface separated by a device attached to the grounding component;
step (D) comprises the step of: adjusting the first and second clamp members of the first clamp to clamp between them the first surface of the first grounding component; and,
step (E) comprises the step of: adjusting the first and second clamp members of the second clamp to clamp between them the second surface of the first grounding component.

17. The method of claim 14 wherein step (C) comprises the steps of:
providing the first clamp with a hole;
providing the second clamp with a hole;
inserting a first end of the electric conductor into the hole in the first clamp; and,
inserting a second end of the electric conductor into the hole in the second clamp.

18. The method of claim 14 wherein step (C) comprises the steps of:
welding a first end of the electric conductor to the first clamp; and,
welding a second end of the electric conductor to the second clamp.

19. The method of claim 14 wherein:
step (D) comprises the step of: adjusting the first and second clamp members of the first clamp to clamp between them a first grounding component; and,
step (E) comprises the step of: adjusting the first and second clamp members of the second clamp to clamp between them a second grounding component that is distinct from the first grounding component.

20. The method of claim 14 wherein:
step (C) comprises the step of providing the electric conductor to comprise a coil having at least one loop of 360 degrees; and,
prior to steps (D) and (E) the method comprises the step of: at least partially uncoiling the electric conductor coil.

* * * * *